US006358081B1

(12) United States Patent
Saka et al.

(10) Patent No.: US 6,358,081 B1
(45) Date of Patent: Mar. 19, 2002

(54) HALF-FITTING PREVENTION CONNECTOR ASSEMBLY

(75) Inventors: Yukinori Saka; Koji Okutani, both of Yokkaichi (JP)

(73) Assignee: Sumitomo Wiring Systems, Ltd. (JP)

( * ) Notice: Subject to any disclaimer, the term of this patent is extended or adjusted under 35 U.S.C. 154(b) by 0 days.

(21) Appl. No.: 09/921,603

(22) Filed: Aug. 6, 2001

(30) Foreign Application Priority Data

Aug. 10, 2000 (JP) ..... 2000-242709

(51) Int. Cl.[7] ..... H01R 13/627
(52) U.S. Cl. ..... 439/352; 439/489
(58) Field of Search ..... 439/350, 352, 439/353, 489

(56) References Cited

U.S. PATENT DOCUMENTS 5,183,410 A * 2/1993 Inaba et al. ..... 439/489
5,628,648 A 5/1997 Higgins, Jr. et al. ..... 439/352
5,820,399 A * 10/1998 Shirouzu et al. ..... 439/352
5,848,912 A * 12/1998 Okabe ..... 439/489

* cited by examiner

*Primary Examiner*—Renee Luebke
*Assistant Examiner*—Briggette R. Hammond
(74) *Attorney, Agent, or Firm*—Banner & Witcoff, Ltd.

(57) ABSTRACT

The invention provides a connector in which the fitting operation and the detection of a half-fitted state can be easily performed. While two connector housings 11 and 20 are being correctly fitted together, coiled springs 50 move a slider 40 from a movement permitting position to a movement preventing position, and the two connector housings 11 and 20 are doubly locked. At this juncture, observing the movement of the slider 40 allows one to detect whether the two connector housings 11 and 20 have been correctly fitted. Since merely fitting the two connector housings 11 and 20 causes these two operations to occur, the operation is simpler. Moreover, the resilient returning force of the coiled springs 50 is less than that required to separate the two connector housings 11 and 20. Consequently, the fitting force of the connector can be reduced.

10 Claims, 7 Drawing Sheets

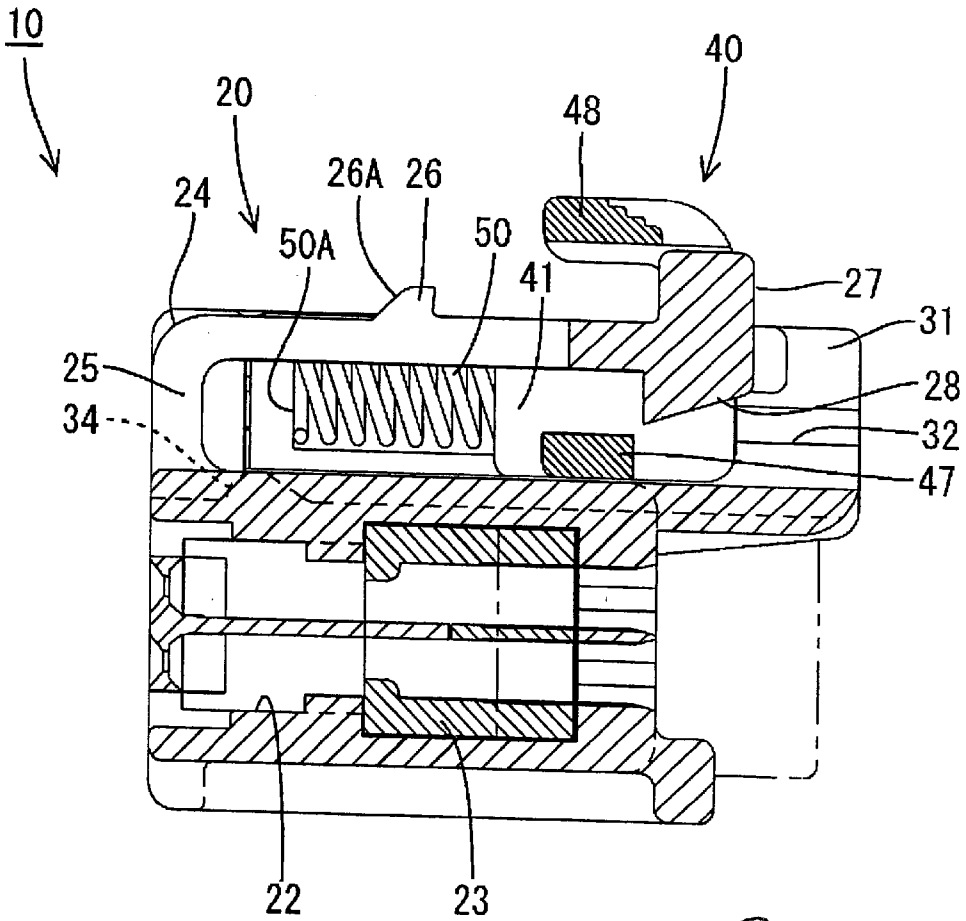
Fig 1
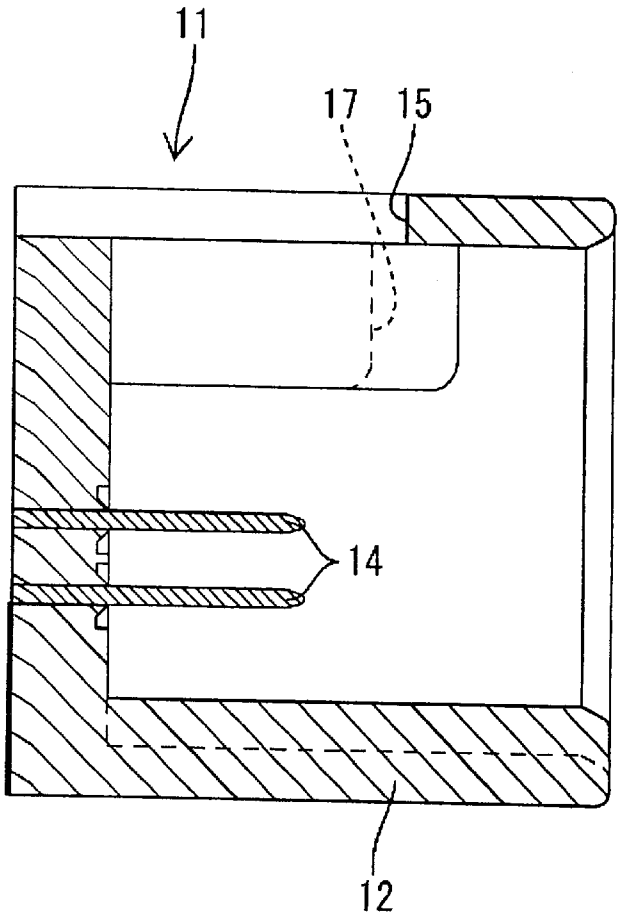

PRIOR ART

HALF-FITTING PREVENTION CONNECTOR ASSEMBLY

TECHNICAL FIELD

The present invention relates to a connector, in particular to an electrical connector provided with a half-fitting detecting function.

BACKGROUND TO THE INVENTION

One example of a connector provided with a half-fitting detecting function is described in JP 8-264230. In this connector, as shown in FIG. 14 of this specification, a locking arm 3 provided on an upper face of the first connector housing 1 moves resiliently while connector housings 1 and 2 are being fitted together so as to rise over a locking receiving member 4 provided on the second connector housing 2. While the two connector housings 1 and 2 are being fitted correctly together, this locking arm 3 returns to its original position and engages with the locking receiving member 4, thereby locking the two connector housings 1 and 2 in a latched state. After the two connector housings 1 and 2 have been correctly fitted together, a slider 5 which surrounds the locking arm 3 is slid towards the connector housing 2, in the direction in which the locking arm 3 extends. This prevents the locking arm 3 from moving in a lock releasing direction, thereby doubly locking the two connector housings 1 and 2. Furthermore, if the fitting operation of the two connector housings 1 and 2 is halted while they are in a half-fitted state, the slider 5 cannot be moved to the position in which it prevents the locking arm 3 from moving. Consequently, the operator can ascertain that the two connector housings 1 and 2 are in a half-fitted state.

The operation of assembling this connector must be performed in two phases: the two connector housings 1 and 2 must be fitted together, and the slider 5 must be moved in order to ascertain whether the two connector housings 1 and 2 are in a half-fitted state. As a result, the operation is complex.

The present invention has taken the above problem into consideration, and aims to present a connector in which assembly and the detection of a half-fitted state can be easily performed.

SUMMARY OF THE INVENTION

According to the invention there is provided a connector assembly comprising two connector housings adapted for mutual fitting along an insertion axis, one of the connector housings having a resilient latching arm extending in the direction of said axis in the rest condition, and engageable by bending with a latching member of said other connector housing, and said one connector housing further including a slider slidable thereon in the direction of said axis between a blocking position in which bending of said latching arm is prevented and a non-blocking position in which bending movement of said latching arm is permitted, the non-blocking position being closer to said other connector housing than the blocking position, and said slider having a spring thereon, one end of said spring being compressed by said other housing on fitting of said connector housings to urge said slider away from said other housing wherein said latching arm including a regulating member engageable with said slider during bending of said latching arm whereby movement of said slider from the non-blocking position is prevented, wherein said regulating member is released from said slider in the rest position of said latching arm to permit movement of said slider to the blocking position.

The invention provides double latching of the connector with a reduced spring force.

In a preferred embodiment the latching arm is cantilevered and has an operating member at the free end thereof. In the blocking position the slider preferably covers this operating member, and the slider may pass over and under the operating member to restrict up and down movement thereof.

BRIEF DESCRIPTION OF DRAWINGS

Other features of the invention will be apparent from the following description of a preferred embodiment shown by way of example only in the accompanying drawings in which:

FIG. 1 is a side cross-sectional view showing two connector housings of the present embodiment in a state prior to being fitted together.

DESCRIPTION OF PREFERRED EMBODIMENT

An embodiment of the present invention is described below with the aid of FIGS. 1 to 13.

Figure 2:
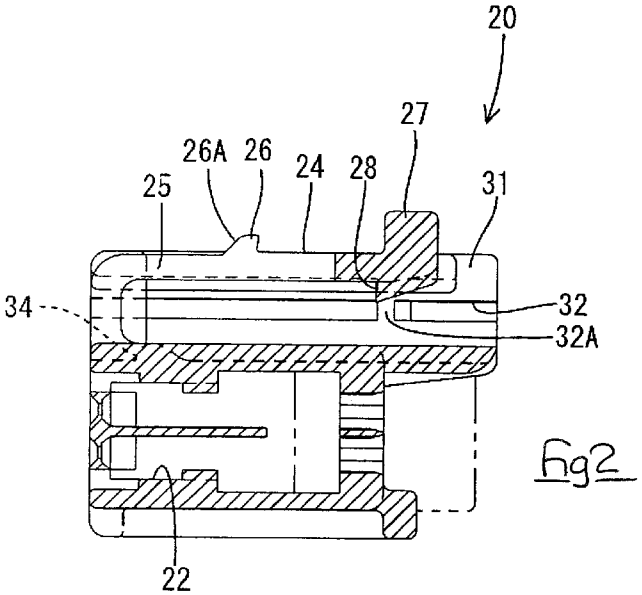
FIG. 2 is a side cross-sectional view showing a female connector housing.
Figure 3:
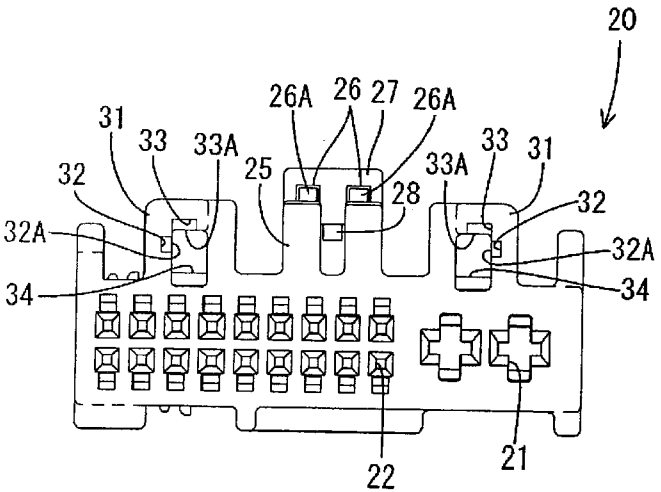
FIG. 3 is a front view of the female connector housing.
Figure 7:
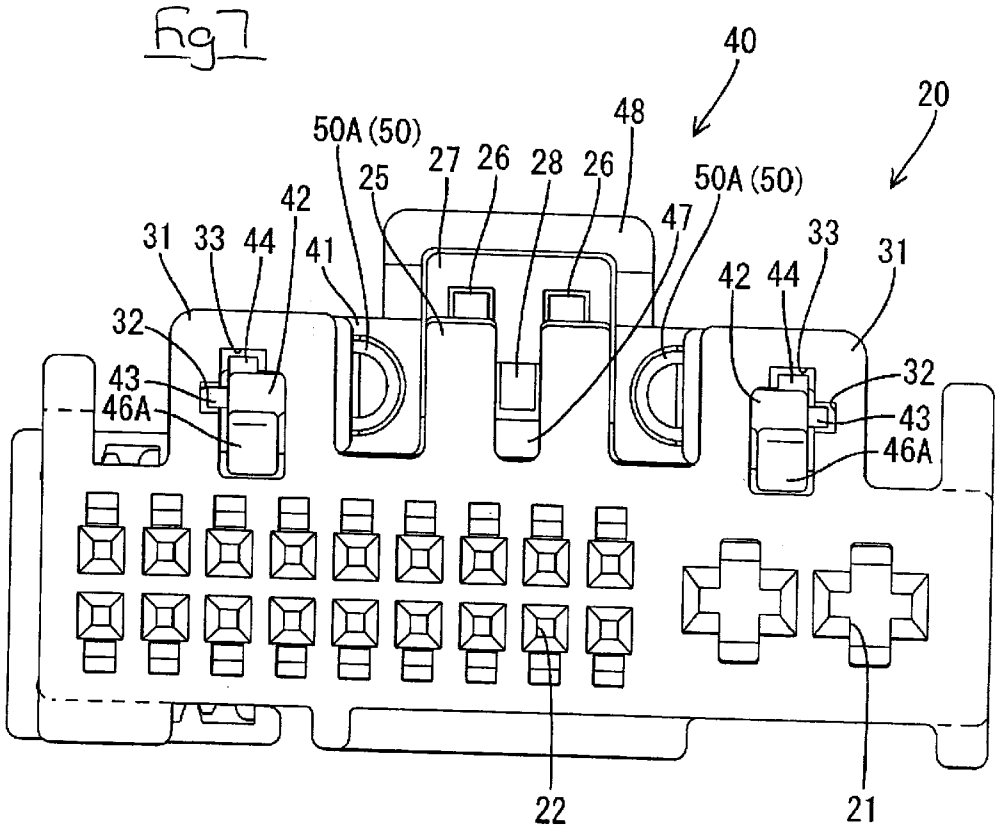
FIG. 7 is a front view showing the slider attached to the female connector housing.

A connector 10 of the present embodiment is provided with a female connector housing 20 and a male connector housing 11 (only a portion of this male connector housing 11 is shown in the figures). The female connector housing 20 and the male connector housing 11 are capable of being fitted together and separated. In the present embodiment, mutually facing sides of the connector housings 11 and 20 are considered to be anterior faces; upper and lower sides are with respect to FIG. 1.

the female connector housing 20 is made from plastic and, as shown in FIGS. 2 and 3, is provided with a plurality of large and small cavities 21 and 22 which house female terminal fittings (not shown). A retainer 23 (see FIG. 1, not shown in detail) can be inserted from the side into the female connector housing 20, this retainer 23 retaining the female terminal fittings within the cavities 21 and 22. A locking arm 24 is formed in a unified manner on an upper face of the female connector housing 20 at a central location relative to the left-right direction thereof. This locking arm 24 is provided with a left and right pair of foot members 25. These foot members 25 protrude upwards from an anterior end of the female connector housing 20, then turn backwards at a right angle, extend towards the posterior, and are unified at their posterior ends. A locking protrusion 26 is formed on an upper face of each foot member 25, these locking protrusions 26 engaging with locking receiving members 15 of the male connector housing 11 (to be explained).

When the two connector housings 11 and 20 are in a separated state or in a correctly fitted state, the locking arm 24 is maintained in a locking position (see FIG. 2) whereby it is substantially parallel to an upper face of the female connector housing 20. While the two connector housings 11 and 20 are being fitted together, the locking arm 24 moves into a lock-releasing position (see FIG. 12) whereby a posterior end thereof is inclined downwards as a result of the locking protrusions 26 sliding under the male connector housing 11.

Taper-shaped guiding faces 26A are formed at an anterior end of each locking protrusion 26. When the two connector housings 11 and 20 are fitted together, these guiding faces 26A make sliding contact with an anterior end of the male connector housing 11, thereby causing the locking arm 24 to move into the lock-releasing position. An operating protrusion 27 protrudes upwards from a posterior end portion of the locking arm 24. When the two connector housings 11 and 20 are to be separated, pushing this operating protrusion 27 moves the locking arm 24 in the lock-releasing position. A slider regulating member 28 protrudes below the operating protrusion 27 at the posterior end portion of the locking arm 24. When the locking arm 24 is in the lock-releasing position, this slider regulating member 28 engages with a slider 40 (to be described), thereby preventing the slider 40 from moving towards the posterior.

A pair of guiding walls 31 protrude from the upper face of the female connector housing 20, these being located to left and right sides of the locking arm 24, and being separated by a specified distance therefrom. The pair of guiding walls 31 is long and narrow in an anterior-posterior direction, and each guiding wall 31 has a cross-sectional C-shape that is open at an inner side (that is, the side thereof facing the opposing guiding wall 31). Slider edge members 42 of the slider 40 (to be described) fit into the inner sides of these guiding walls 31, thereby maintaining the slider 40 in a manner whereby it can slide in the anterior-posterior direction. Side grooves 32 and upper grooves 33, each extending along the anterior-posterior direction, are formed in inner side faces and ceiling faces respectively of the guiding walls 31. Stoppers 32A and 33A protrude within these grooves 32 and 33 at locations somewhat towards the posterior relative to the centre thereof. Furthermore, slider stopping members 34 protrude from inner base faces of the guiding walls 31 at locations in the vicinity of the anterior ends thereof, posterior faces of these slider stopping members 34 being gently inclined, and anterior faces thereof being steeply inclined.

Figure 4:
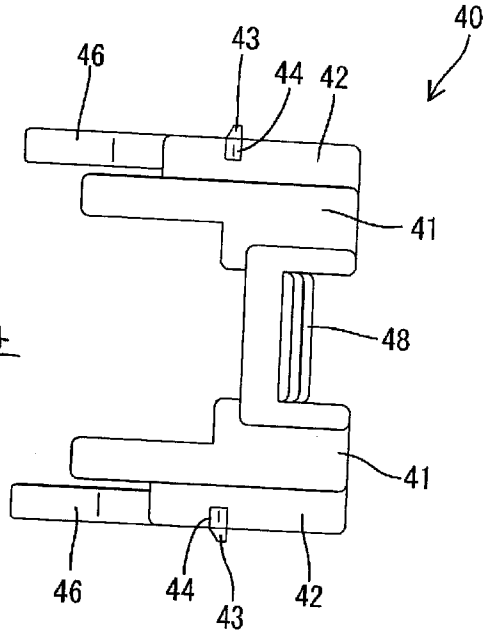
FIG. 4 is a plan view of a slider.
Figure 5:
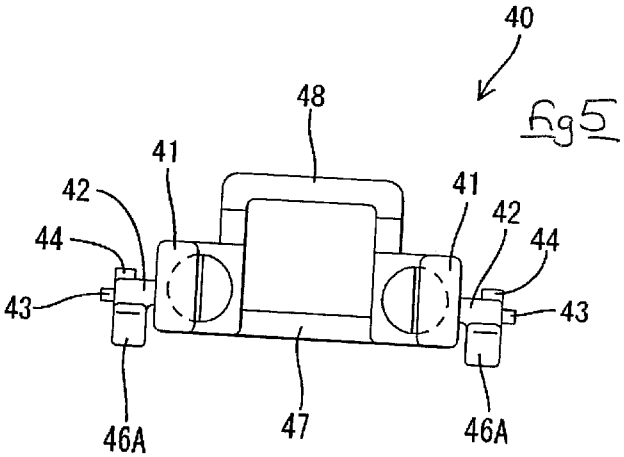
FIG. 5 is a front view of the slider.
Figure 6:
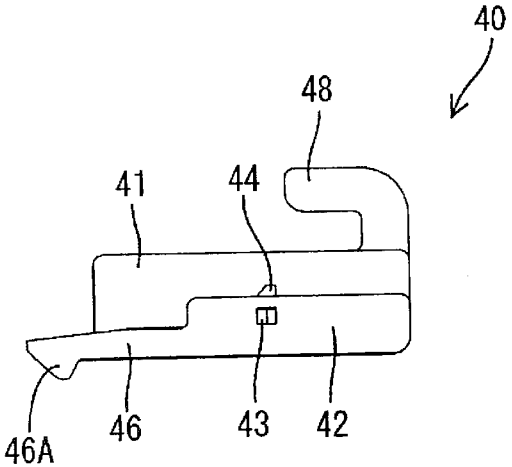
FIG. 6 is a side face view of the slider.
Figure 9:
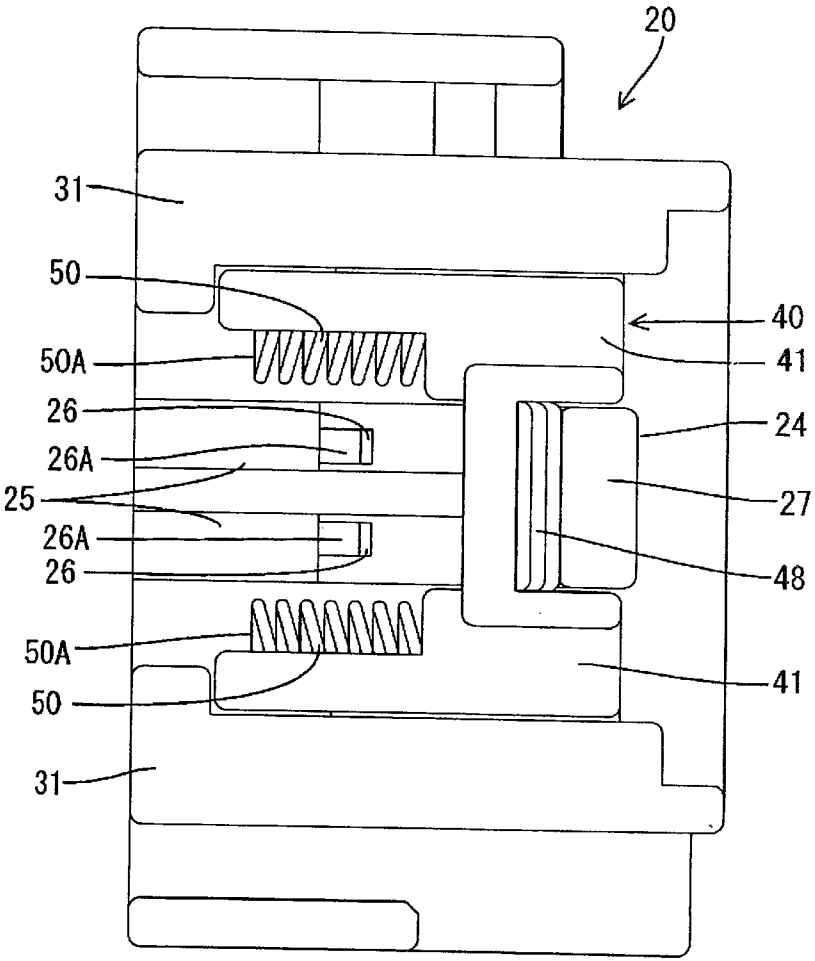
FIG. 9 is a plan view of the female connector housing when the slider is in a movement permitting position.
Figure 8:
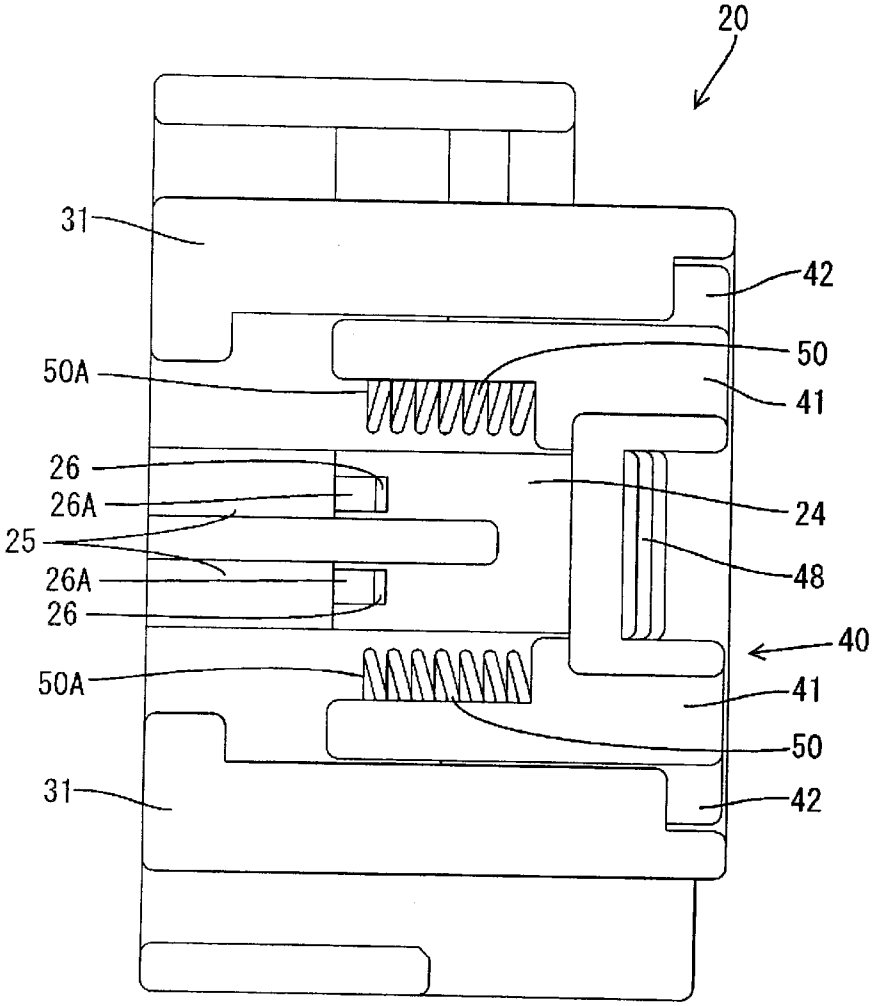
FIG. 8 is a plan view showing the female connector housing when the slider is in a movement preventing position.

The slider 40 is made in a unified manner from plastic. As shown in FIGS. 4 to 6, the slider 40 is provided with a left and right pair of spring housing members 41 that are long and narrow and protrude in the fitting direction of the two connector housings 11 and 20. Each spring housing member 41 is cylindrical, and houses a coiled spring 50 in a state whereby this coiled spring 50 can be resiliently compressed. Anterior portions of inner side faces (that is, the mutually opposing faces) of the spring housing members 41 are open. Anterior end portions 50A of the coiled springs 50 (which are in an attached state) are exposed from these anterior portions (see FIGS. 7 and 8). When the two connector housings 11 and 20 are fitted together (to be explained), pushing members 17 of the male connector housing 11 make contact with the anterior end portions 50A of the coiled springs 50 and push them in a direction of compression.

The coiled springs 50 are compressed while the two connector housings 11 and 20 are being fitted together. As will be explained later, the returning force of the coiled springs 50 is such that, if the two connector housings 11 and 20 are released while being fitted together, the force is not sufficient to separate the two connector housings 11 and 20. However, it is sufficient to move the slider 40 to a movement preventing position after the two connector housings 11 and 20 have been correctly fitted together.

A long and narrow slider edge member 42 protrudes in an anterior-posterior direction along an outer side face (relative to the widthwise direction thereof) of each spring housing member 41. Each slider edge member 42 of the slider 40 fits into the inner sides of the left and right guiding walls 31, thereby maintaining the slider 40 in a manner whereby it can slide along the upper face of the female connector housing 11 in the fitting direction of the two connector housings 11 and 20. A protrusion 43 and a protrusion 44 protrude from an outer side face and upper face respectively of each slider edge member 42. These protrusions 43 and 44 fit into the side grooves 32 and the upper grooves 33 respectively of the guiding walls 31. The protrusions 43 and 44 are retained by the stoppers 32A and 33A provided towards the posterior of the grooves 32 and 33; this maintains the slider 40 in a posterior end position (i.e., the movement preventing position, see FIG. 8). Moreover, a retaining member 46, which is capable of moving resiliently upwards and downwards, protrudes to the anterior from each slider edge member 42. A retaining protrusion 46A protrudes downwards from an anterior end of each retaining member 46. These retaining protrusions 46A fit resiliently with the slider stopping members 34 provided near the anterior ends of the guiding walls 31, thereby maintaining the slider 40 in an anterior end position (i.e., the movement permitting position, see FIGS. 7 and 9).

A square pillar-shaped movement regulating member 47 joins the two spring housing members 41 at posterior ends thereof. A U-shaped slider operating member 48 is provided in a bridge shape at upper portions of the posterior ends of the spring housing members 41. When the two connector housings 11 and 20 are in the correctly fitted state (see FIG. 13), the slider operating member 48 extends above the male connector housing 11. Pushing the slider operating member 48 towards the anterior moves the slider 40 from the movement preventing position to the movement permitting position. When the slider 40 is in the movement preventing position (see FIGS. 8 and 13), the movement regulating member 47 enters below the slider regulating member 28 of the locking arm 24, thereby preventing the locking arm 24 from moving into the lock-releasing position. At this juncture, the slider operating member 48 covers an upper face of the operating protrusion 27 of the locking arm 24, thereby preventing the operating protrusion 27 from being pushed accidentally. When the slider 40 is in the movement permitting position (see FIGS. 1, 9, and 11), the slider regulating member 28 of the locking arm 24 is located to the posterior of the movement regulating member 47, the locking arm 24 is able to move into the lock-releasing position, and the operating protrusion 27 is exposed at the posterior of the slider operating member 48 in a state whereby this operating protrusion 27 can be pushed.

Figure 10:
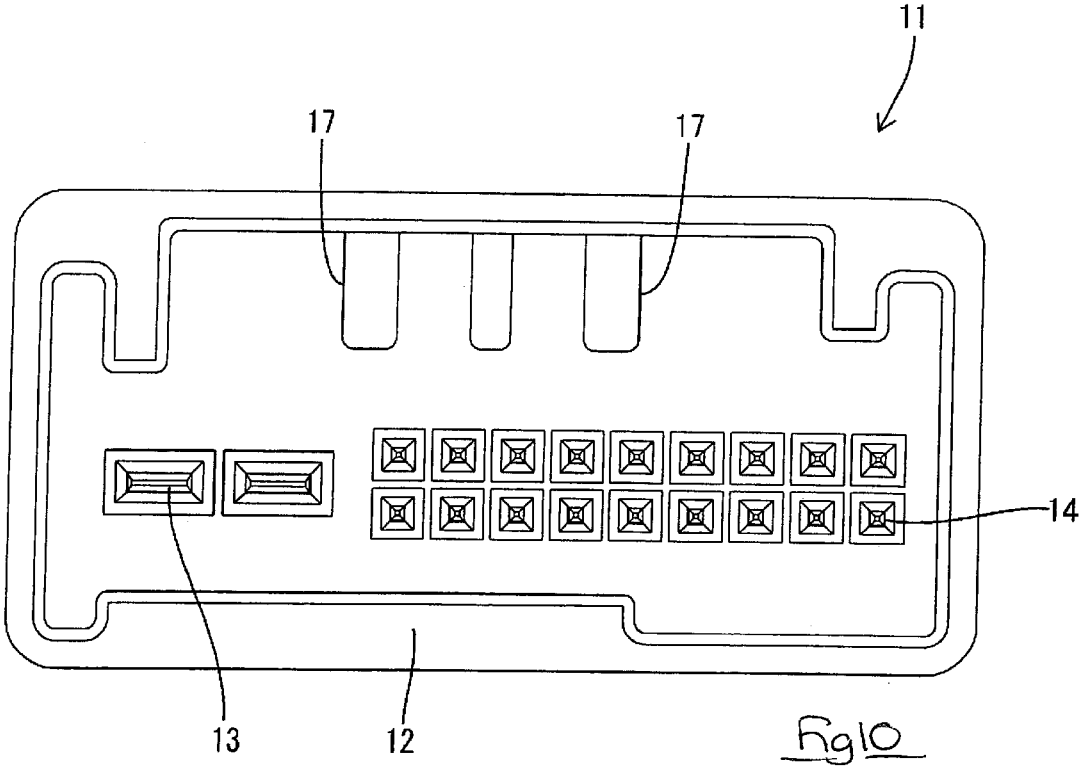
FIG. 10 is a front view showing a male connector housing.
Figure 11:
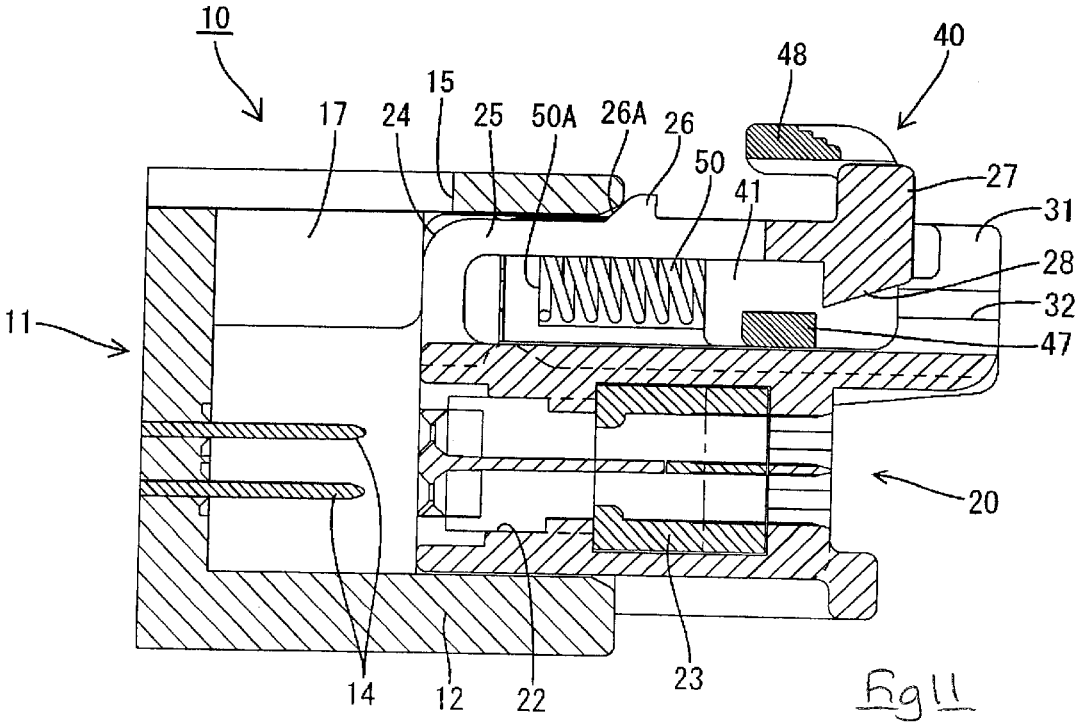
FIG. 11 is a side cross-sectional view showing a locking protrusion making contact with the male connector housing while fitting is taking place.
Figure 12:
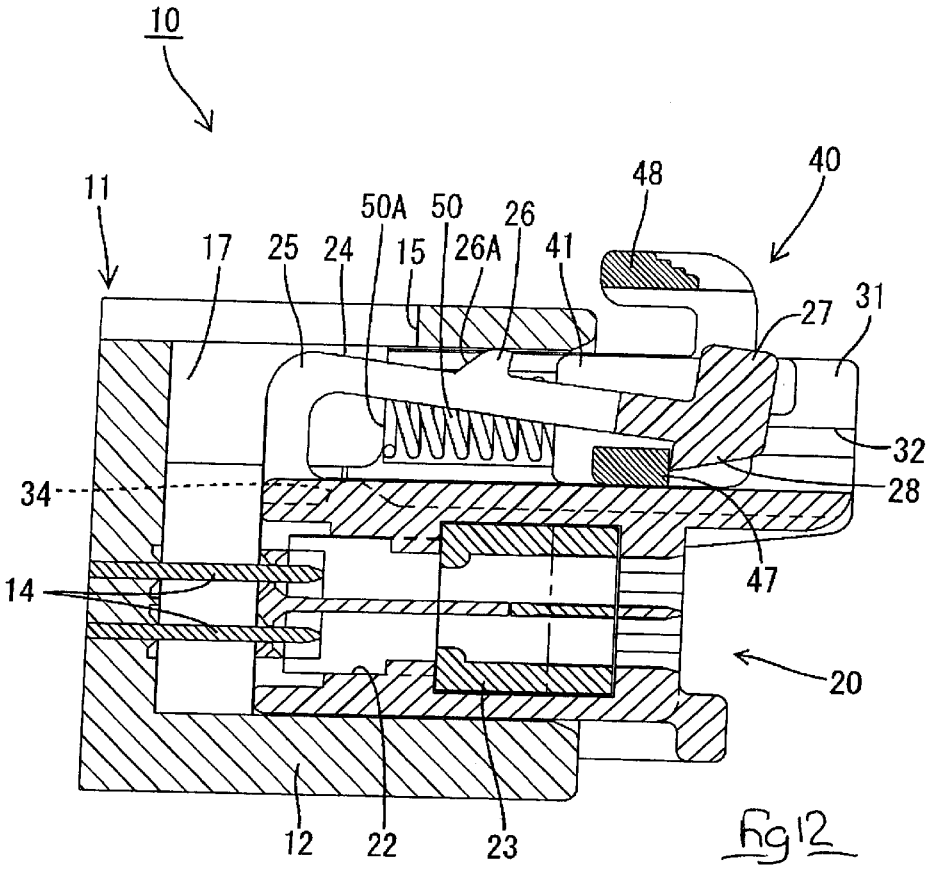
FIG. 12 is a side cross-sectional view showing a pushing member making contact with a coiled spring while fitting is taking place.
Figure 13:
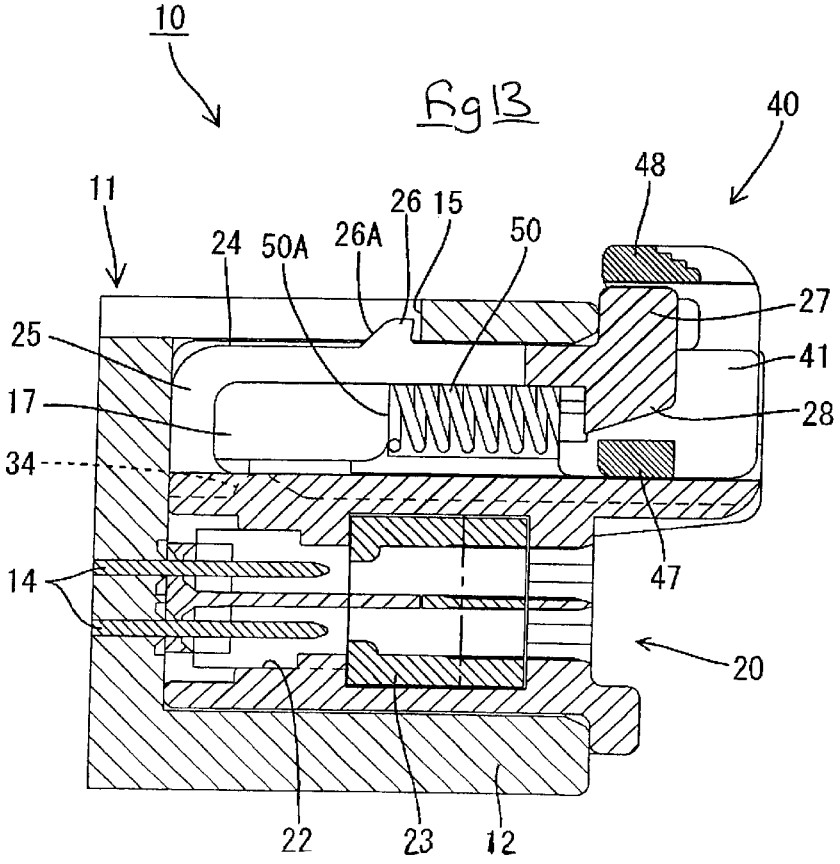
FIG. 13 is a side cross-sectional view showing a correctly fitted state.
Figure 14:
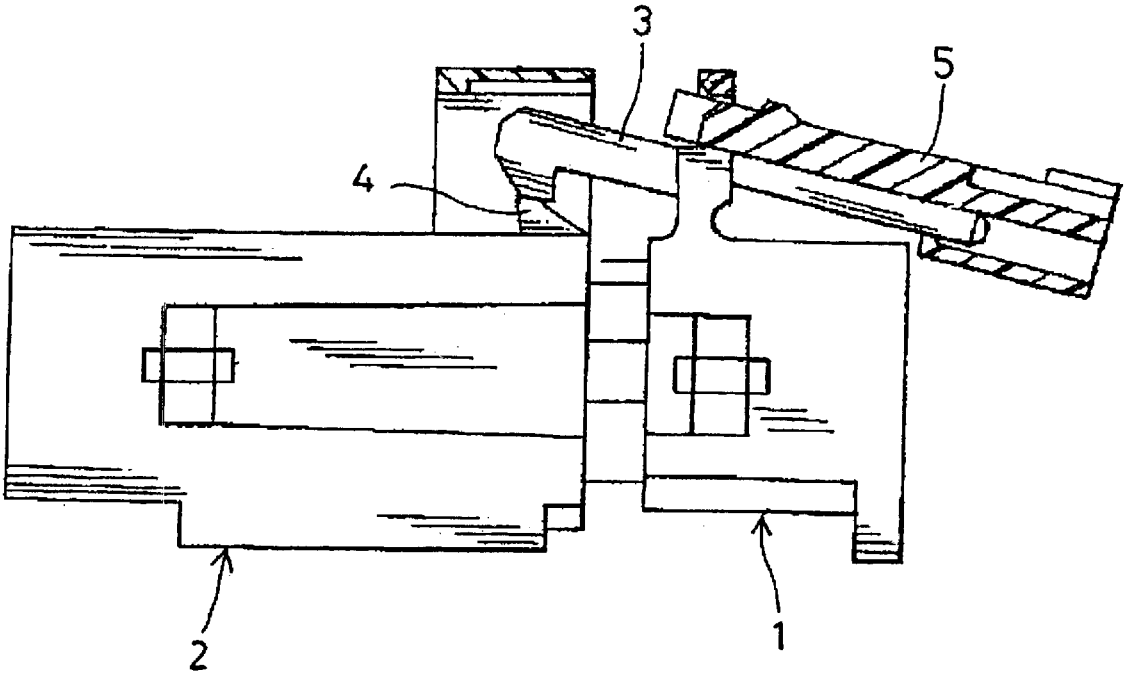
FIG. 14 is a side cross-sectional view of a prior art connector.

The male connector housing 11 is made from plastic. As shown in FIGS. 1 and 10, an angular tubular hood 12 protrudes from an anterior face of this male connector housing 11, the female connector housing 20 fitted therewith. The male connector housing 11 houses a plurality of male terminal fittings (not shown in their entirety) which are provided with tabs 13 and 14. These tabs 13 and 14 protrude into the hood 12 and, when the fitting occurs, they enter the cavities 21 and 22 of the female connector housing 20 and make contact with the female terminal fittings. The locking receiving members 15 are formed by cutting away portions of an edge of an upper face of the hood 12. The locking protrusions 26 of the locking arm 24 enter these locking receiving members 15, thereby engaging the two and maintaining the two connector housings 11 and 20 in an inseparable state. Moreover, three protrusions are aligned in a left-right direction within an upper portion of the hood 12 near the centre thereof. A left and right pair of these protrusions form the pushing members 17. When the two connector housings 11 and 20 are fitted together, these pushing members 17 enter between the foot members 25 of the locking arm 24 and the guiding walls 31, make contact with the anterior end portions 50A of the coiled springs 50, and push these coiled springs 50 in a direction of compression.

The present embodiment is configured as described above. Next, the operation thereof will be described.

Before the fitting operation begins, the retaining protrusions 46A of the retaining member 46 are engaged with the slider stopping members 34, thereby maintaining the slider 40 in the movement permitting position. When the two connector housings 11 and 20 are to be fitted together, the slider 40 is maintained in the movement permitting position while they are brought together. When fitting begins, the guiding faces 26A of the locking protrusions 26 make contact with opening edges of the hood 12 (see FIG. 11). Then, the locking protrusions 26, being guided along their inclined guiding faces 26A, slide against a wall face of the hood 12, this pushing the locking arm 24 into the lock-releasing position. At the same time, the slider regulating member 28 of the locking arm 24 engages from the posterior with the movement regulating member 47 of the slider 40. At this juncture, the pushing members 17 of the male connector housing 11 have not yet made contact with the anterior end portions 50A of the coiled springs 50.

As the fitting operation progresses from this state, the pushing members 17 of the male connector housing 11 make contact with the anterior end portions 50A of the coiled springs 50 (this is the state shown in FIG. 12), and the coiled springs 50 are compressed. At this juncture, the pushing force exerted on the coiled springs 50 by the pushing members 17 is received by the slider 40. However, since the slider regulating member 28 is engaged with the movement regulating member 47, the slider 40 is prevented from moving towards the posterior. Consequently, the coiled springs 50 are compressed and a resilient returning force thereof is accumulated.

When the two connector housings 11 and 20 have reached the correctly fitted state, the locking protrusions 26 engage with the locking receiving members 15, and the locking arm 24 moves back into the lock-releasing position. Then the slider regulating member 28 is released from the movement regulating member 47, and the compressed force of the coiled springs 50 moves the retaining members 46 of the slider 40 upwards, the retaining protrusions 46A rising over the slider stopping members 34, and the slider 40 moving towards the posterior. Then the protrusions 43 and 44 of the slider edge members 42 make contact with the stoppers 32A and 33A, and the slider 40 reaches the movement preventing position (see FIG. 13).

In the correctly fitted state, the movement regulating member 47 of the slider 40 is located below the slider regulating member 28 of the locking arm 24, thereby preventing the locking arm 24 from moving into the lock-releasing position. As a result, the two connector housings 11 and 20 are in a doubly locked state.

If the fitting operation is halted while the two connector housings 11 and 20 are in a half-fitted state, the operator can see that the slider operating member 48, which extends above the upper face of the male connector housing 11, is immobile in the movement permitting position. Consequently, he will realise that the two connector housings 11 and 20 are not correctly fitted together. Furthermore, if the two connector housings 11 and 20 are left untouched at the phase where the pushing members 17 have compressed the coiled springs 50 (the phase before that shown in FIG. 13), the resilient returning force of the coiled springs 50 is exerted on the two connector housings 11 and 20. However, this returning force is not sufficient to separate the two connector housings 11 and 20.

In the conventional connector, a spring member provided on the first connector housing is compressed while the fitting operation takes place. If the fitting operation is halted before it is complete, the resilient returning force of the spring member separates the two connector housings, allowing the half-fitted state to be detected. In this type of connector, the resilient returning force of the spring member must be sufficient to counter the frictional force between the two connector housings, the frictional force between the male and female terminal fittings, etc., and to separate the two connector housings. Consequently, a strong force needs to be exerted to fit the connector. However, in the connector 10 of the present embodiment, the resilient returning force of the coiled springs 50 is weaker than the force required to separate the two connector housings 11 and 20. Consequently, the force required to fit the connector can be reduced.

When the two connector housings 11 and 20 are to be separated from the correctly fitted state, the slider operating member 48 is first pushed towards the anterior, this moving the slider 40 from the movement preventing position to the movement permitting position. Then, as the slider 40 is maintained in the movement permitting position, the operating protrusion 27 of the locking arm 24 is pushed downwards, this moving the locking arm 24 into the lock-releasing position. Then the connector housings 11 and 20 are separated.

As has been described above, the resilient returning force of the coiled springs 50 is less than that of the conventional example. Consequently, this separating operation is easy. Furthermore, in the correctly fitted state, the slider operating member 48 of the slider 40 covers the upper face of the operating protrusion 27 of the locking arm 24. Consequently, it is the slider operating member 48 which must be handled in order to move the slider 40. As a result, the operator does not confuse the sequence when the two connector housings 11 and 20 are to be separated, and is prevented from moving the operating protrusion 27 prior to moving the slider 40.

In the present embodiment, when the two connector housings 11 and 20 are correctly fitted together, the coiled springs 50 push the slider 40 from the movement permitting position to the movement preventing position, thereby doubly locking these two connector housings 11 and 20. Furthermore, observing the movement of the slider 40 allows one to detect whether the two connector housings 11 and 20 have been correctly fitted. Merely fitting the two connector housings 11 and 20 together causes these two operations to occur, thereby simplifying the operation.

Moreover, when the two connector housings 11 and 20 are correctly fitted together, the operating protrusion 27 of the locking arm 24 is covered by the slider operating member 48 of the slider 40. Consequently, the operator does not confuse the sequence of what is to be moved first when the two connector housings 11 and 20 are to be separated.

The slider regulating member 28 is located at a tip of the locking arm 24. As a result, the slider regulating member 28 has a greater degree of movement (this allowing the slider 40 to move between the movement preventing position and the movement permitting position) than if it were provided at another location. Consequently, the size of the connector 10 does not need to be increased.

Furthermore, the resilient returning force of the coiled springs 50 is less than that required to separate the two connector housings 11 and 20. Consequently, the fitting force of the connector is decreased, and the fitting operation can be performed easily.

The present invention is not limited to the embodiments described above with the aid of figures. For example, the possibilities described below also lie within the technical range of the present invention.

(1) In the embodiment described above, the female connector housing 20 provided with the slider 40 and the coiled springs 50 is the first connector housing, and the male connector housing 11 is the second connector housing. However, according to the present invention, the male connector housing could equally well be the first connector housing, and the female connector housing could equally well be the second connector housing.

(2) In the embodiment described above, an outer face of the operating protrusion 27 of the locking arm 24 is covered by the slider operating member 48 of the slider 40, thereby preventing this operating protrusion 27 from being moved accidentally. However, according to the present invention, it need not be the slider operating member of the slider that functions as a covering member. Furthermore this covering member need not be provided on the slider.

(3) In the embodiment described above, the resilient returning force of the coiled springs 50 is less than that required to separate the two connector housings 11 and 20, thereby improving operability. However, according to the present invention, the spring member may equally well have a strong resilient returning force, this separating the two connector housings when they are in a half-fitted state, and this separation allowing the operator to detect the half-fitted state.

What is claimed is:

1. A connector assembly comprising two connector housings adapted for mutual fitting along an insertion axis, one of the connector housings having a resilient latching arm extending in the direction of said axis in the rest condition, and engageable by bending with a latching member of said other connector housing, and said one connector housing further including a slider slidable thereon in both directions of said axis between a blocking position in which bending of said latching arm is prevented and a non-blocking position in which bending movement of said latching arm is permitted, the non-blocking position being closer to said other connector housing than the blocking position, and said slider having a spring thereon, one end of said spring being compressed by said other housing on fitting of said connector housings to urge said slider away from said other housing wherein said latching arm includes a regulating member engageable with said slider during bending of said latching arm whereby movement of said slider from the non-blocking position is prevented, and wherein said regulating member is released from said slider in the rest position of said latching arm to permit movement of said slider to the blocking position.

2. An assembly according to claim 1 wherein the force generated by said spring during fitting of said connector housings is insufficient to separate said housings at a fitting depth just before latching of said resilient latching arm with said latching member, and wherein the force generated by said spring at said fitting depth is sufficient to move said slider.

3. An assembly according to claim 1 wherein said regulating member is at the free end of said latching arm.

4. An assembly according to claim 1 wherein said latching arm includes a latching projection engageable in an aperture defined in said other connector housing, one side of said aperture defining said latching member.

5. An assembly according to claim 1 wherein said slider includes a resilient leg having a protrusion thereon, said protrusion being releasably engageable with an abutment defined on said one housing to define a releasable latch in the non blocking position.

6. An assembly according to claim 1 wherein said slider includes a slider protrusion thereon and engageable with an abutment defined on said one housing to define a releasable latch in the blocking position.

7. An assembly according to claim 1 wherein said slider extends on either side of said latching arm and a said spring is provided on either side of said latching arm.

8. An assembly according to claim 1 wherein said latching arm is cantilevered and extends away from said other connector housing, and said slider covers said latching arm in the blocking position.

9. An assembly according to claim 8 wherein the free end of said latching arm comprises an operating portion, and said slider covers said operation portion in the blocking position.

10. An assembly according to claim 9 wherein said slider includes slider members which pass over and under the free end of said latching arm in the blocking position, thereby to restrict movement of said free end.

* * * * *